US007942122B2

(12) United States Patent
Shieh et al.

(10) Patent No.: US 7,942,122 B2
(45) Date of Patent: May 17, 2011

(54) ENGINE HEAD COVER ASSEMBLY HAVING AN INTEGRATED OIL SEPARATOR AND A REMOVABLE COVER

(75) Inventors: Tenghua Tom Shieh, Ann Arbor, MI (US); Naveen Rajan, Peoria, IL (US); Wei Liu, Canton, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 315 days.

(21) Appl. No.: 12/191,646

(22) Filed: Aug. 14, 2008

(65) Prior Publication Data

US 2009/0038579 A1 Feb. 12, 2009

Related U.S. Application Data

(63) Continuation-in-part of application No. 11/565,872, filed on Dec. 1, 2006, now abandoned.

(51) Int. Cl.
*F01M 9/10* (2006.01)
*F02B 25/06* (2006.01)

(52) U.S. Cl. ..... 123/90.38; 123/572

(58) Field of Classification Search ..... 123/90.38, 123/195 C, 572–574
See application file for complete search history.

(56) References Cited

U.S. PATENT DOCUMENTS

| | | | |
|---|---|---|---|
| 6,453,892 | B1 | 9/2002 | Plunkett et al. |
| 6,530,367 | B2 | 3/2003 | Akiwa et al. |
| 7,380,545 | B2 | 6/2008 | Shieh et al. |
| 2002/0112710 | A1 | 8/2002 | Akiwa et al. |

FOREIGN PATENT DOCUMENTS

| | | | |
|---|---|---|---|
| DE | 4437714 | A1 | 7/1995 |
| EP | 1428992 | A1 | 6/2004 |

*Primary Examiner* — Noah Kamen
(74) *Attorney, Agent, or Firm* — Gifford, Krass, Sprinkle, Anderson & Citkowski, P.C.

(57) ABSTRACT

A head cover assembly for covering a crankcase of an internal combustion engine includes a head cover, a removable cover, a guide, and an integral oil separator. The oil separator includes a labyrinth that defines a flow path that separates oil from crankcase gases passing therethrough. The guide includes a tubular body presenting a passage for which manifold vacuum may draw crankcase gas from the oil separator. The cover includes an aperture. The tubular body is disposed through the aperture such that the outer tube surface is spaced apart from the inner edge of the aperture to define a gap in which separated oil may drain back into the engine for recycling.

17 Claims, 5 Drawing Sheets

FIG - 1
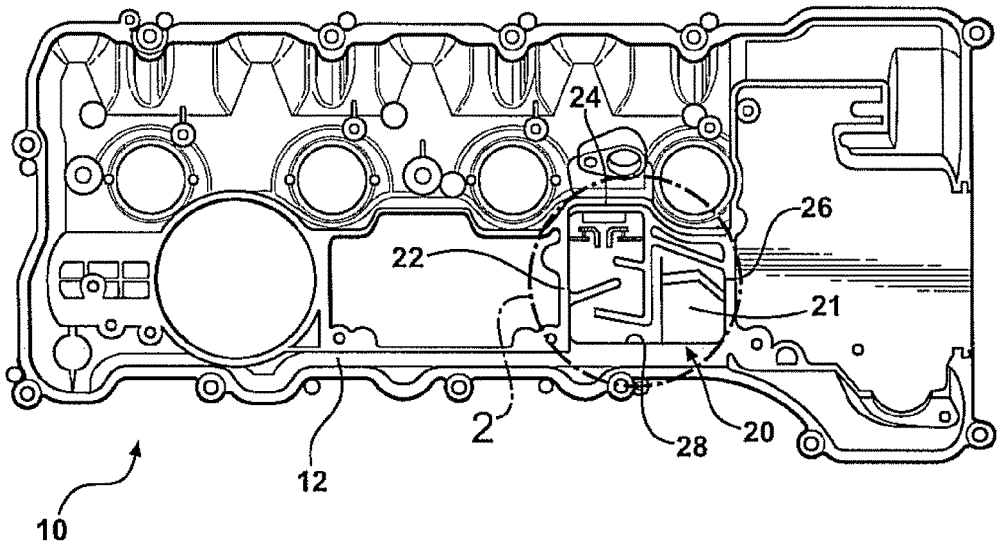
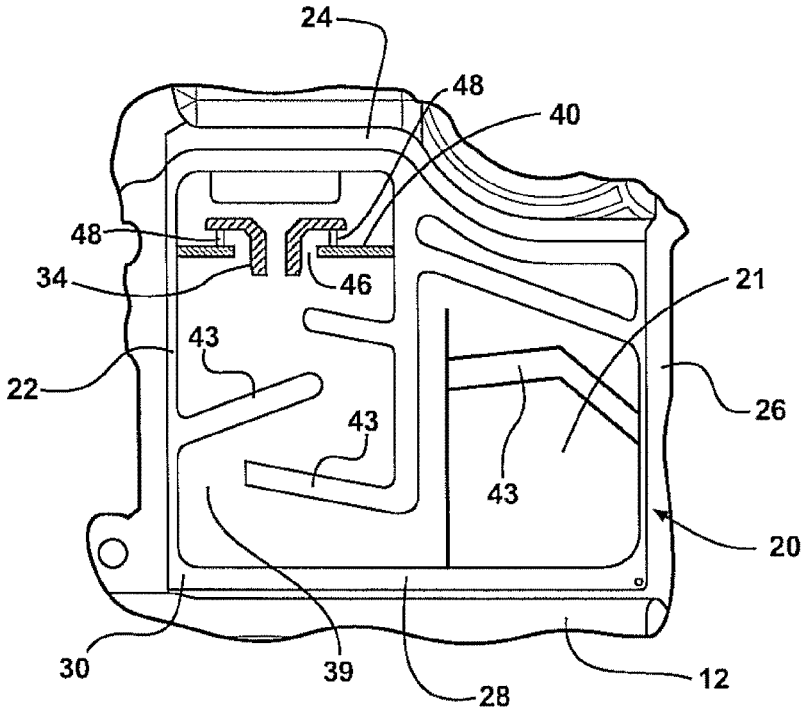
FIG - 2

FIG - 4
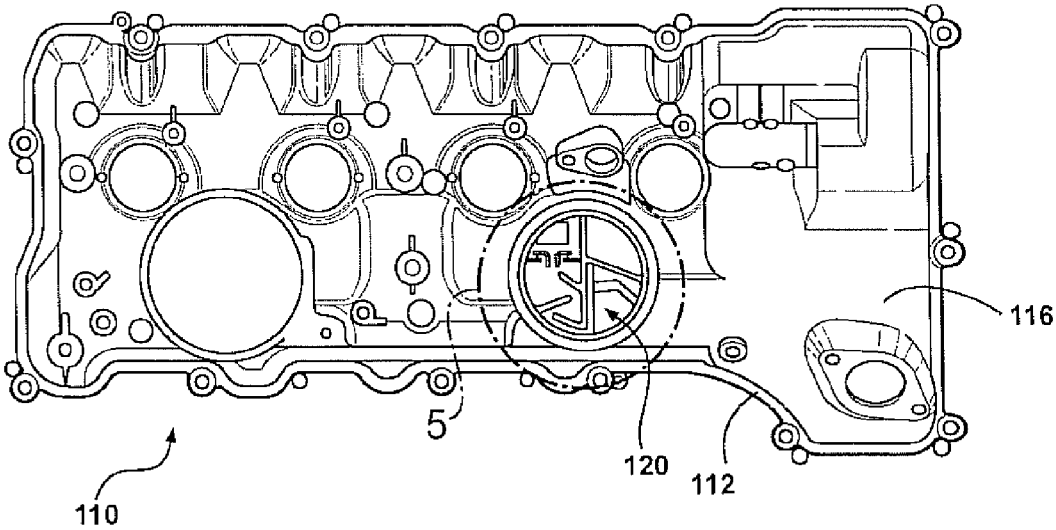
FIG - 5
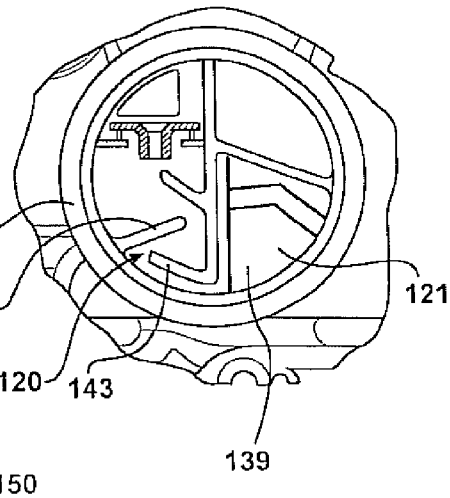
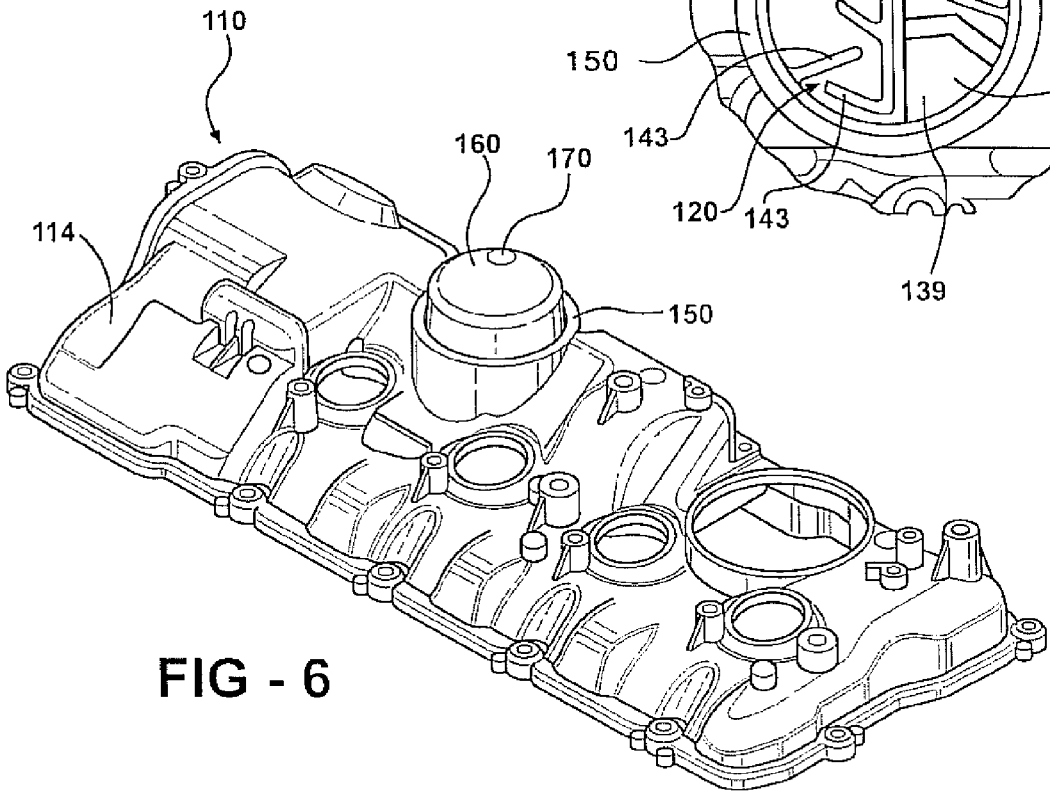
FIG - 6

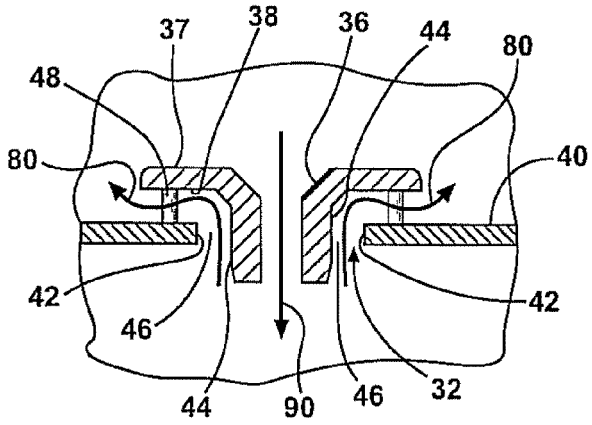
FIG - 7
FIG - 8
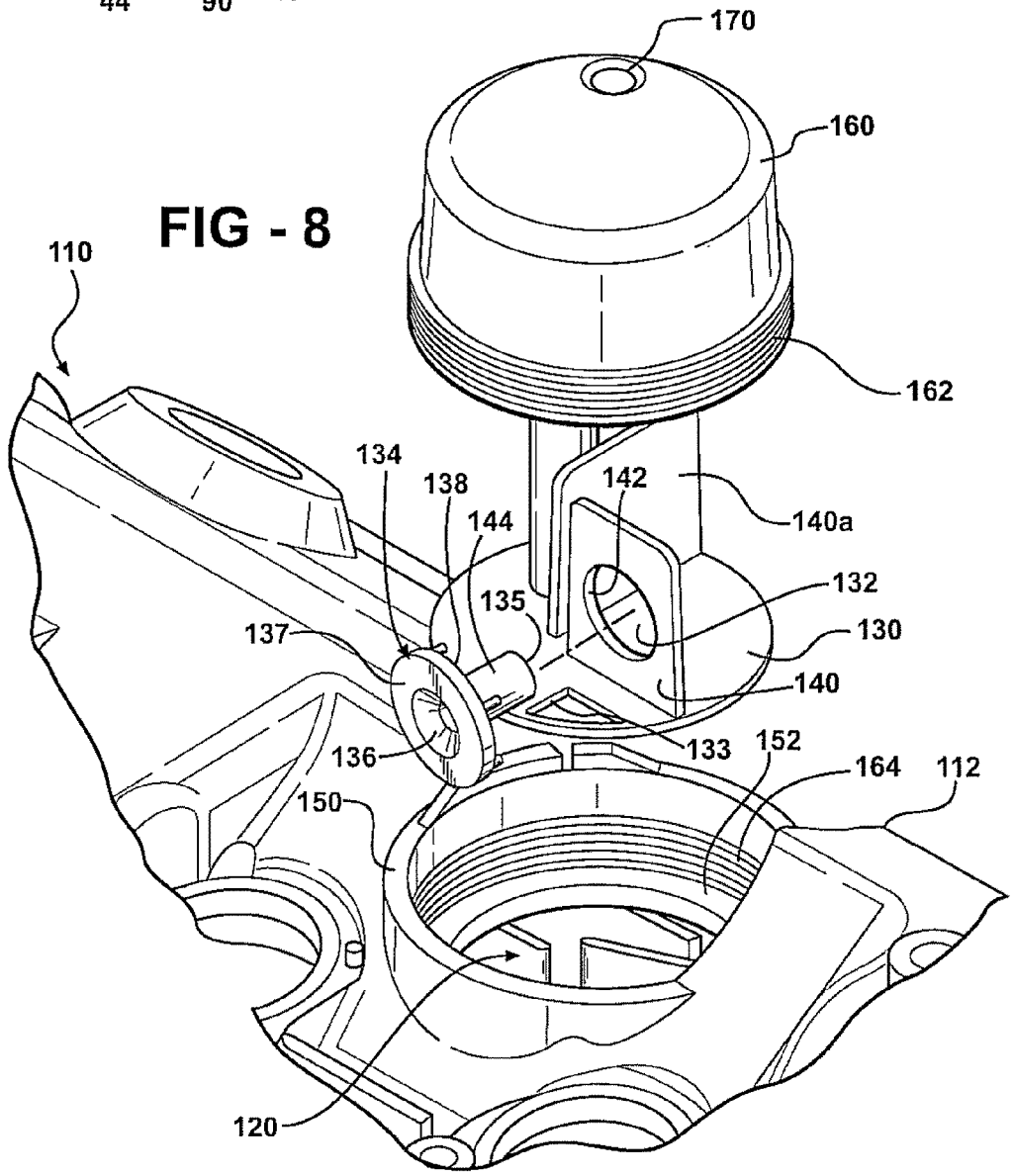

FIG - 9
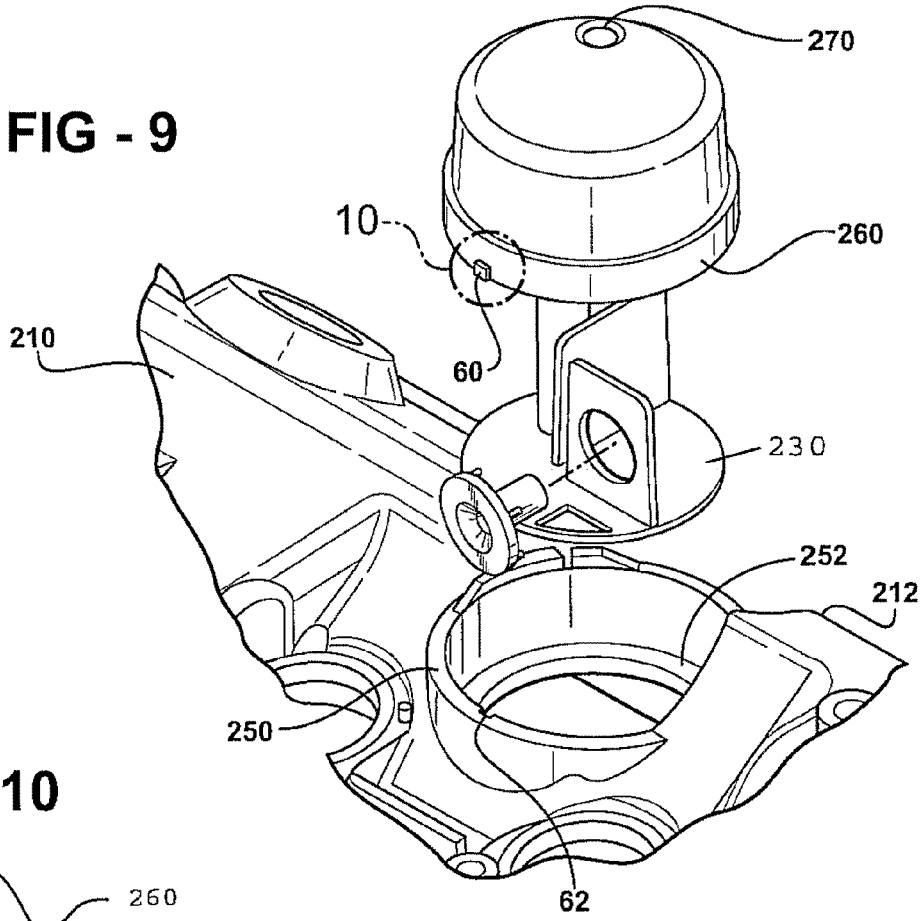
FIG - 10
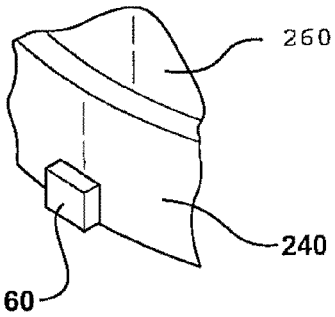
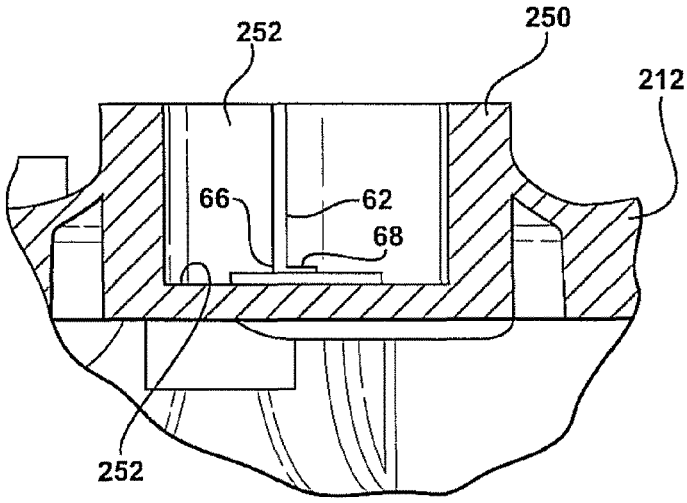
FIG - 11

ENGINE HEAD COVER ASSEMBLY HAVING AN INTEGRATED OIL SEPARATOR AND A REMOVABLE COVER

CROSS REFERENCE TO RELATED APPLICATIONS

This application is a continuation-in-part of U.S. patent application Ser. No. 11/565,872, filed Dec. 1, 2006, entitled "Engine Head Cover Assembly Having an Integrated Oil Separator."

FIELD OF THE INVENTION

The invention relates to an engine head cover for an internal combustion engine. More particularly, the invention relates to an engine head cover having a removable cover and a guide so as to allow for separated oil from crankcase gases to be returned to the engine.

BACKGROUND OF THE INVENTION

An internal combustion engine typically includes a combustion chamber, where a fuel air mixture is burned to cause movement of a set of reciprocating pistons, and a crankcase, which contains the crankshaft driven by the pistons. During operation, it is normal for the engine to experience "blow-by," wherein combustion gases leak past the piston-cylinder gap from the combustion chamber and into the crankcase. These blow-by or crankcase gases contain moisture, acids and other undesired by-products of the combustion process.

An engine typically includes a Positive Crankcase Ventilation (PCV) system for removing harmful gases from the engine and prevents those gases from being expelled into the atmosphere. The PCV system does this by using manifold vacuum to draw vapors from the crankcase into the intake manifold. Vapor is then carried with the fuel/air mixture into an intake manifold of the combustion chambers where it is burned. Generally, the flow or circulation within the system is controlled by the PCV valve, which acts as both a crankcase ventilation system and as a pollution control device.

It is normal for crankcase gases to also include a very fine oil mist. The oil mist is carried by the PCV system to the manifold. The oil mist is then burned in the combustion chamber along with the fuel/air mixture. This results in an increase in oil consumption. A known method of removing oil from the crankcase gases is to use an oil separator. The crankcase gases flow through the oil separator. Localized high velocity areas in the oil separator promote separation of oil from the gases. The oil is re-introduced back to a sump via a drain device. The sump generally holds excess oil in the system.

It remains desirable to provide an improved oil separator that is more efficient than conventional oil separator designs in the removal of oil from crankcase gases. It also remains desirable to improve the separation of oil from crankcase gases without increasing the size of the engine head cover. It also remains desirable to have a head cover assembly with an integrated oil separator that is relatively easy to assemble and repair.

SUMMARY OF THE INVENTION AND ADVANTAGES

According to one aspect of the invention, a head cover assembly is provided for covering a crankcase of an internal combustion engine. The head cover assembly includes a head cover, an oil separator, and a removable cover. The head cover has opposite outer and inner surfaces. The oil separator separates oil from crankcase gases passing through an inlet. The oil separator is disposed along an inner surface of the head cover. The removable cover may be disposed either above or below the oil separator. The removable cover includes a guide configured so as to allow crankcase gases to be drawn from the oil separator into the engine intake, and oil separated from the crankcase gases to return to the engine.

BRIEF DESCRIPTION OF THE DRAWINGS

Advantages of the present invention will be readily appreciated as the same becomes better understood by reference to the following detailed description when considered in connection with the accompanying drawings, wherein:

FIG. 1 is a bottom view of a head cover assembly having an integral oil separator according to one embodiment of the invention;

FIG. 2 is an enlarged bottom view of a portion of the head cover assembly shown in FIG. 1;

FIG. 4 is a bottom view of a head cover assembly according to a second embodiment of the invention;

FIG. 5 is an enlarged bottom view of a portion of the head cover assembly shown in FIG. 4;

FIG. 6 is a top perspective view of the head cover assembly of FIG. 4;

FIG. 7 is a cross-sectional view of the cover and the guide;

FIG. 8 is an enlarged exploded top perspective view of a portion of the head cover assembly of FIG. 4;

FIG. 9 is an enlarged exploded perspective view of a portion of the head cover assembly according to a third embodiment of the invention;

FIG. 10 is an enlarged perspective view of a portion of the head cover assembly of FIG. 8 showing a side of an oil separator cap with a tab for securing the cap to a head cover; and FIG. 11 is a cross sectional view of the head cover assembly of FIG. 8 illustrating the slot for lockingly receiving the tab for securing the cap to the head cover.

DETAILED DESCRIPTION OF THE INVENTION

Figure 3:
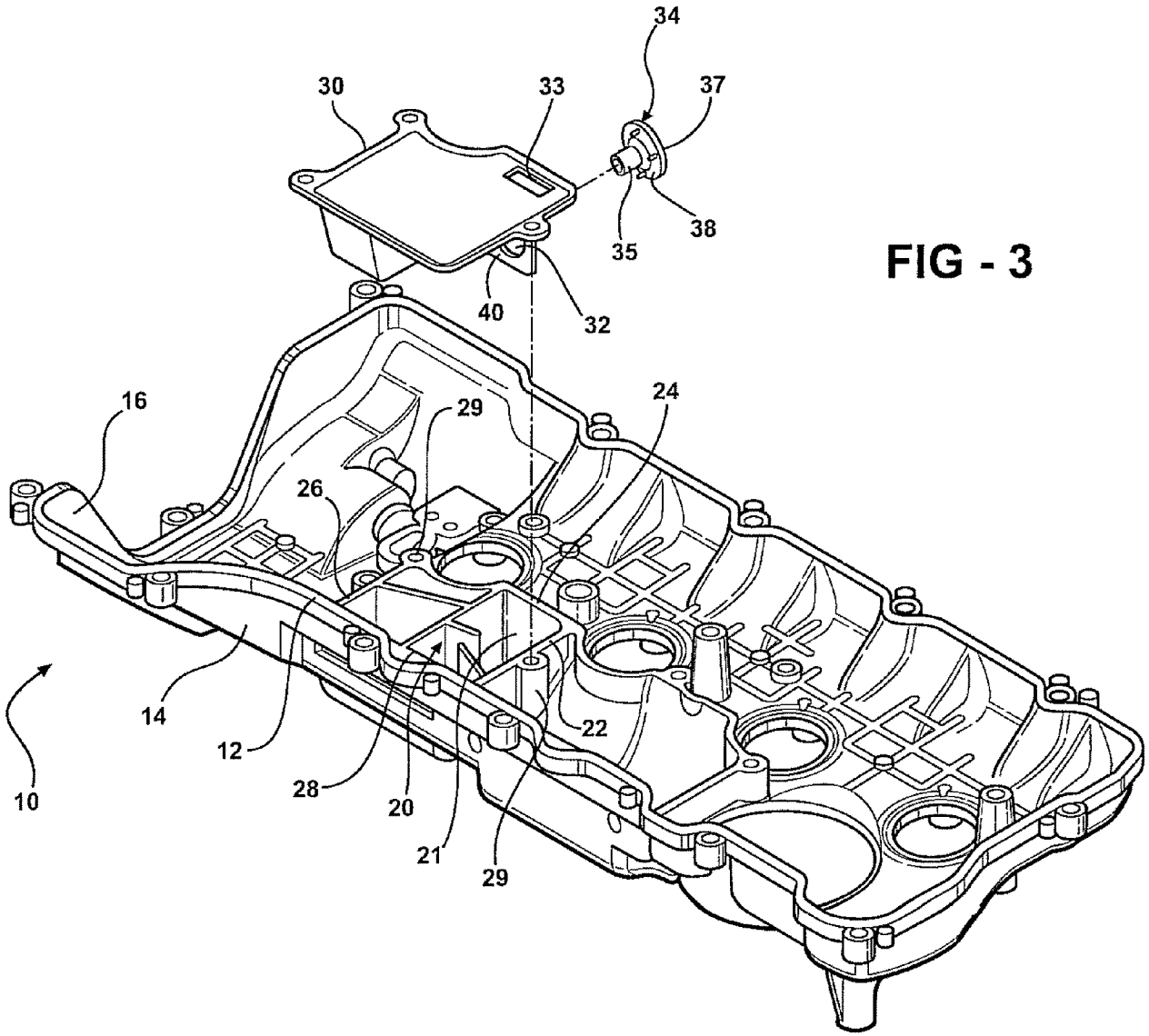
FIG. 3 is an exploded perspective bottom view of file head cover assembly of FIG. 1.

Referring to FIGS. 1-3, a head cover assembly 10 for enclosing a crankcase of an internal combustion engine (not shown) is provided. The head cover assembly 10 includes a head cover 12 having opposite outer and inner surfaces 14, 16, and an intake (not shown). The head cover assembly 10 also includes an oil separator 20 for removing oil from crankcase gases. The oil separator 20 is disposed along the inner surface 16 of the head cover 12, and is defined by a plurality of side walls 22, 24, 26, 28 integrally formed with the head cover 12. At least one of the side walls 28 extends along the inner surface 16 of the head cover 12, while the remaining side walls 22, 24, 26 extend outwardly from the inner surface 16 of the head cover 12. Alternatively, all of the side walls 22, 24, 26, 28 and of the oil separator 20 extend outwardly from the inner surface 16 of the head cover 12. The head cover 12 may be formed from steel, aluminum or any material or combination of materials known by those skilled in the art, which are suitable for use in the heat and the environment associated with the engine and which allows integral formation of at least portions of the oil separator 20 with the head cover 12.

A portion of the head cover 12 extends between the side walls 22, 24, 26, 28 to form an interior space 21 of the oil separator 20. A cover 30 and 130 cooperates with the side walls 22, 24, 26, 28 to enclose the interior space 21, and may be disposed either above or below the oil separator 20, as shown in FIGS. 3 and 8, respectively. The cover 30 includes an aperture 32 for supporting a guide 34, and the guide 34 allows crankcase gases to flow in one direction while simultaneously allowing oil to drain back into the engine or oil sump. The head cover 12 has at least one threaded bore 29 for securing the cover 30 to the side walls 22, 24, 26, 28 using a bolt. A gasket (not shown) may be disposed between the side walls 22, 24, 26, 28 and the cover 30 so as to direct crankcase gases through the guide 34 and into the oil separator 20, and to prevent gases from leaking from the interior space 21 of the oil separator 20.

With reference now to FIG. 3, the head cover assembly 10 may be easily assembled by simply registering the cover 30 to the threaded bores 29 and bolting the cover 30 thereto. Thus both the cover 30 and/or guide 34 may be easily replaced or repaired by removing the head cover 12 and disengaging the cover 30 from the threaded bores 29 and replacing the cover 30 with a like cover.

The oil separator 20 includes an inlet (not shown) and an outlet (not shown). Manifold vacuum draws crankcase gases through the oil separator 20 inlet, out the outlet, and into the intake. A plurality of guide walls 43 extend from the head cover 12 toward the cover 30 to define a path 39 that directs the drawn crankcase gases through the oil separator 20. The path 39 defines a labyrinth and is shaped to promote separation of oil from crankcase gases as the crankcase gases flow through the path 39 between the inlet and outlet. The separated oil is collected in the oil separator 20 and drains back through head and into the oil sump (not shown) for re-use in the engine.

With reference again to FIGS. 1-3 a first preferred embodiment of the head cover assembly 10 is provided. The cover 30 is disposed underneath the oil separator 20, and includes a cover wall 40 extending orthogonal from the cover 30 towards the oil separator 20. Both cover 30 and the cover wall 40 have an aperture 33, and 32 respectively, for allowing crankcase gases to flow through. The guide 34 has a tubular body 35 defining a guide opening 36 and a flange 37 extending radially from one end of the guide opening 36 so as to present an annular surface 38. The aperture 33 of the cover 30 is in communication with the guide 34 and aperture 32 of the cover wall 40 so as to allow crankcase gases from the oil separator 20 to flow through the guide opening 36 into the intake. As shown in FIG. 7, the aperture 32 has an inner edge 42 that is greater than the outer tube surface 44 of the tubular body 35, thus a gap 46 is defined between the tubular body 35 and the wall aperture 32. The tubular body 35 is disposed such that a portion of the tubular body 35 extends through the wall aperture 32 and into the interior of the oil separator 20. The annular surface 38 remains spaced apart from the cover wall 40 so as to allow oil to recycle back into the oil sump.

The guide 34 may be attached to the cover wall 40 using a device such as a bolt or a screw. Alternatively, as shown in the drawings, the guide 34 may be welded to the cover wall 40. Specifically, the flange 37 may include a pair of tabs 48 for engaging the cover wall 40 so as to allow the guide 34 to be welded to the cover wall 40.

With reference again to FIGS. 2 and 7, the operation of the head cover 12 is provided. The cover 30 assists with the removal of oil from crankcase gases. Specifically, as the crankcase gases are drawn through the labyrinth path 39 defined by the oil separator 20 and indicated by arrow 90, oil is separated from the crankcase gases. As the head cover 12 is positioned above the crankcase, gravity forces separated oil back into the oil sump by causing the oil to seep through the gap 46 defined by the space between the inner edge 42 and the outer tube surface 44 as indicated by arrow 80.

Alternatively, the oil separator 20 may have a generally cylindrical side wall that extends from the inner surface 16 of the head cover 12 instead of the straight side walls of the illustrated embodiment. The cover 30 would then have a generally circular shape to cooperate with the generally cylindrical shape of the side wall.

A second embodiment of the head cover assembly 110 is shown in FIGS. 4-8, wherein like parts are indicated by numerals offset by 100. In the second preferred embodiment, the head cover 112 includes a cap 160 with an intake port 170. The cap 160 is configured to engage the head cover 112 so as to enclose the oil separator 120. The intake port 170 allows manifold vacuum to draw crankcase gases from the crankcase and through the oil separator 120. The cover 130 is disposed between the cap 160 and cylindrical side wall 150 of the oil separator 120, which together define an interior space 121 interconnected to the oil separator 120 by an aperture 133. With reference to FIG. 8, both the cap 160 and the cover 130 may be removed from head cover 112. The cylindrical side wall 150 is integrally formed with the head cover 112 and defines a recess 152 for receiving the cap 160 therein. The cap 160 may further include an annular portion with threads 162 for engaging mating threads 164 on the head cover 112. Thus it is inherent that the cover 130 or guide 134 may be easily replaced by simply unscrewing the cap 160 from the recess 152 and inserting a like cap. Furthermore, the head cover assembly 110 is easily assembled as the head cover 112 need only be position on top of and aligned to the engine.

The cover 130 is disposed above the oil separator 120, as shown in FIG. 8. When the head cover assembly 110 is assembled, the cover 130 will be positioned between the cap 160 and the oil separator 120. As stated above, cover 130 includes an aperture 132 so as to allow crankcase gas to be drawn through the oil separator 120 and into the intake port 170. A plurality of cover walls 140 extend generally orthogonal from the cover 130 towards the cap so as to define the flow path 139 for crankcase gases leading into the intake port 170. As shown in FIG. 8, one of the cover walls 140 includes a cover wall aperture 132. The cover 130 supports a guide 134 so as to allow crankcase gas to flow from the oil separator 120 and allow oil to drain back into the engine sump.

With reference again to FIGS. 7 and 8, the guide 134 is configured the same as in the first preferred embodiment. The guide 134 is disposed within the cover wall aperture 132 such that the tubular body 135 extends through the cover wall aperture 132 and away from aperture 133. As in the first embodiment, and the annular surface 138 is spaced apart from the cover wall 140. The guide 134 is fixed to the cover wall 140 in the same manner as described above. However, as the cover 130 is disposed above the oil separator 120, crankcase gases are first passed through the oil separator 120 before reaching the cover 130. Thus, as crankcase gases are drawn from the engine and through the oil separator 120, the crankcase gases are directed through aperture 132 into the interior space of the cap 160 through the guide opening 136. Oil remaining in the crankcase gases is further separated by contact with the cover wall **140*a* and the oil is allowed to drain back into the engine through the gap 46 defined by the space between the inner edge 142 of aperture 132 and the outer tube surface 144**.

During assembly, the cap 160 is inserted into the recess formed by the cylindrical side wall 150. The cap 160 is simply screwed into the threaded cylindrical side wall 150, thereby securing the cap 160 to the head cover 112. The cap 160 is fully inserted when it contacts a locating surface formed on the head cover 112 adjacent a bottom end of the cylindrical side wall 150.

A third embodiment of the head cover assembly 210 are shown in FIGS. 9-11. In this embodiment, the threads from the second embodiment are replaced with a cap tab 60 and slot arrangement, wherein a cap tab 60 extends outwardly from the annular portion 240 of the cap 260 and a guide slot 62 is formed in the cylindrical side wall 250. Both the cap 260 and the cover 230 may be removed from engagement with the head cover 212. The guide slot 62 extends in a generally longitudinal direction along the cylindrical side wall 250. A key slot 68 extends generally orthogonally from an end 66 of the guide slot 62. During assembly, the cap 260 is inserted into the recess defined by the cylindrical side wall 250. The cap tab 60 slides in the guide slot 62 toward the key slot 68. The cap is fully inserted when it contacts the locating surface 252 at the bottom of the recess. The cap is then turned so that the cap tab 60 slides into the key slot, thereby securing the oil separator 20 to the head cover 212. Alternatively, the cap tab 60 and slot arrangement may be reversed, wherein the cap tab 60 extends from the head cover 212 and slots 62 and 68 are formed in the cap 260.

In the illustrated embodiments, the guide walls 43 are arranged in the form of a labyrinth, which promotes the separation of oil from the crankcase gases as the gases flow therealong. Alternatively, the oil separator 20 may be a cyclone type oil separator, wherein the guide wall 43 is a coil that defines a spiral-shape flow path 39 that extends between the inlet and the outlet of the oil separator. It should be appreciated by those having ordinary skill in the art that other types of oil separators may be integrated with the head cover 12. Alternatively, the head cover 12 may integrate more than one type of oil separating arrangement, such as a combination between labyrinth and cyclone type oil separating arrangements.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, it is clear that the invention may be practiced other than as specifically described.

The invention claimed is:

1. A head cover assembly for covering a crankcase of an internal combustion engine, said head cover assembly comprising:

a head cover having opposite outer and inner surfaces;

an oil separator for separating oil from crankcase gases passing therethrough, the oil separator being disposed along an inner surface of the head cover, the oil separator having at least one side wall integral with the head cover, which together with the head cover define an interior space of the oil separator;

a cover enclosing the interior space of the oil separator, having an aperture with an inner edge, wherein said cover being removable from the oil separator; and a guide having a tubular body, wherein said tubular body having an outer tube surface, wherein a portion of said tubular body extends through said aperture, and said outer tube surface being spaced apart from said inner edge so as to define a gap, and wherein said permitting engine crankcase gases to flow from said oil separator into the engine intake, and said gap permitting separated oil to drain back into the engine.

2. A head cover assembly as set forth in claim 1, wherein the oil separator further includes a plurality of side walls, one of the side walls extending along the inner surface of the head cover.

3. A head cover assembly as set forth in claim 2, wherein the oil separator includes a plurality of guide walls that are integral with the head cover and extend between the inner surface and the cover to define a labyrinth path that causes separation of oil from crankcase gases passing therethrough.

4. A head cover assembly as set forth in claim 3, wherein said guide further includes a flange extending radially from one end of said tubular body so as to define an annular surface, and said annular surface is spaced apart from said cover.

5. A head cover assembly as set forth in claim 4, wherein said cover further includes a wall extending generally orthogonal from said cover towards said oil separator.

6. A head cover assembly as set forth in claim 5, wherein said aperture is defined on said wall.

7. A head cover assembly as set forth in claim 5, including a cap releasably attachable to the at least one side wall to define the interior space of the oil separator.

8. A head cover assembly as set forth in claim 7, wherein said cover is disposed between the cap and the head cover to enclose the interior space of the oil separator.

9. A head cover assembly as set forth in claim 8, wherein said wall extends away from said oil separator.

10. A head cover assembly as set forth in claim 9, wherein said aperture is defined on said wall.

11. A head cover assembly as set forth in claim 10, wherein the cap includes threads for engaging mating threads on the at least one side wall.

12. A head cover assembly as set forth in claim 7, wherein the cap and the at least one side wall are coupled to each other by a tab and slot arrangement, wherein the cap is rotated relative to the at least one side wall to cause locking engagement between a tab and a key slot.

13. A head cover assembly as set forth in claim 12, wherein the tab extends outwardly from the cap and the key slot is formed in the at least one side wall.

14. A head cover assembly as set forth in claim 13, wherein the at least one side wall is generally cylindrical and forms a recess for receiving the cap therein.

15. A head cover assembly as set forth in claim 14, wherein the at least one side wall includes a guide slot that receives the tab from the cap as the cap is inserted into the recess.

16. A head cover assembly as set forth in claim 15, wherein the key slot extends orthogonally from an end of the guide slot so that rotation of the cap within the recess causes locking engagement between the tab and the key slot.

17. A head cover assembly as set forth in claim 1, wherein the at least one side wall is cylindrically shaped to define a cylindrical recess in the head cover.

* * * * *